United States Patent [19]

Dirksing et al.

[11] 4,114,195

[45] Sep. 12, 1978

[54] FLUID INJECTOR

[75] Inventors: Robert S. Dirksing; Estel R. Todd, both of Cincinnati, Ohio

[73] Assignee: The Procter & Gamble Company, Cincinnati, Ohio

[21] Appl. No.: 845,064

[22] Filed: Oct. 25, 1977

[51] Int. Cl.[2] ..... B01F 5/12

[52] U.S. Cl. ..... 366/167; 366/173

[58] Field of Search ..... 366/167, 168, 171-173, 366/134, 137; 137/230, 240, 246.11, 806, 808, 812

[56] References Cited

U.S. PATENT DOCUMENTS

| | | | |
|---|---|---|---|
| 2,527,689 | 10/1950 | Suthard et al. | 366/167 |
| 2,692,764 | 10/1954 | Hanson | 366/160 |
| 3,166,020 | 1/1965 | Cook | 366/137 X |
| 3,826,474 | 7/1974 | Pareja | 366/167 |
| 3,985,300 | 10/1976 | Pinney | 137/239 X |

*Primary Examiner*—Leonard D. Christian

*Attorney, Agent, or Firm*—Melville, Strasser, Foster & Hoffman

[57] ABSTRACT

A fluid injector for the introduction, dispersion and mixing of a first fluid into a second fluid flowing through a conduit. The injector comprises an elongated body mounted in fluid-tight fashion through an aperture in the side of the conduit so as to extend transversely of the interior of the conduit and transversely of the flow of the second fluid therein. The injector body has an axial bore connectable at one end to a source of the first fluid under pressure and leading to at least one outlet bore extending transversely of the injector body and located within the conduit. The injector body has a transverse inlet bore within the conduit. One end of the inlet bore faces the flow of the second fluid within the conduit and the other end thereof communicates with the axial bore of the injector body upstream of the at least one outlet bore. A portion of the second fluid enters the inlet bore of the injector and is conducted to the axial bore of the injector to mix therein with the first fluid, the mixture being ejected into the flow of the second fluid within the conduit through the at least one injector outlet bore. Additional mixing of the first and second fluids occurs in the conduit as the result of turbulence therein caused by the presence of the injector and taking place immmediately downstream of the injector.

12 Claims, 4 Drawing Figures

FLUID INJECTOR

BACKGROUND OF THE INVENTION

1. Field of the Invention

The invention relates to means for the introduction, dispersion and mixing of a first fluid into a second fluid, and more particularly to an injector for the first fluid adapted to extend transversely across a conduit containing a flow of the second fluid.

2. Description of the Prior Art

The fluid injector of the present invention may be utilized whenever it is desired to inject one fluid into the flow of another with mixing of the two. While not so limited, for purposes of an exemplary showing the fluid injector of the present invention will be described in its use as a rinse aid injector in the rinse water supply pipe of a commercial dishwasher.

In the typical commercial dishwasher, tableware is caused to pass therethrough on a conveyor. During its passage, the tableware is subjected to a preselected combination of washing and rinsing steps. Near the end of its passage through the dishwasher, the tableware is subjected to a final rinse. The final rinse water is sprayed upon the tableware by one or more spray arches or nozzles. It is desirable that the final rinse water contain a small amount of rinse aid, thoroughly mixed therewith. The rinse aid causes the final rinse water to sheet off the tableware, preventing the formation of spots and films thereon.

In the usual prior art practice, the rinse aid is introduced into the supply pipe for the final rinse water spray nozzles, upstream of the nozzles. To accomplish this prior art workers have utilized a rinse aid injector to port rinse aid fluid through the side of the supply pipe. In its most usual form, the injector comprises a simple fitting connected to a source of rinse aid fluid under pressure and having a nose portion adapted to be threadedly engaged in a female pipe port in the final rinse water supply pipe. The nose of the rinse aid injector extends into the supply pipe only a little distance, if at all. Thorough mixing of the rinse aid fluid in the final rinse water has not hitherto been accomplished at the point of introduction of the rinse aid fluid into the final rinse water. The greater the viscosity of the rinse aid fluid, the greater is its tendency to simply flow along the inside surface of the supply pipe. Since the final rinse water supply pipe usually contains a rinse water valve and a siphon breaker, the rinse aid fluid must be introduced into the supply pipe down stream of these elements and therefore the length of supply pipe upstream of the nozzles and available for mixing is limited. Typical flow rates of the rinse water through the supply pipe are low and develop little turbulence. These factors inhibit thorough mixing. Prior art workers have generally counted upon the presence of one or more 90° bends in the supply pipe to assist in mixing. downstream The rinse aid injector of the present invention is simple in construction, inexpensive to manufacture, easy to install and provides thorough mixing and dispersion of the rinse aid fluid into the final rinse water at and immediately downstreamm of the injector.

SUMMARY OF THE INVENTION

The rinse aid fluid injector of the present invention comprises an elongated, rod-like body which may be mounted in fluid tight fashion through an aperture in the side of the final rinse water supply pipe of a commercial dishwasher. For example, a conventional male tubing connector for use in a female pipe port may be utilized to mount the rinse aid injector.

The elongated body of the rinse aid injector is provided with an axial bore, one end of which may be appropriately connected to a supply of rinse aid fluid under pressure. The other end of the axial bore connects with at least one transverse outlet bore extending transversely of the injector body and located within the final rinse water supply pipe. The injector body also has an inlet bore located within the confines of the supply pipe. One end of the inlet bore faces the flow of final rinse water in the supply pipe. The other end of the inlet bore communicates with the axial bore of the injector upstream of the at least one outlet bore.

In operation, rinse aid fluid is pumped into the axial bore of the injector. A portion of the final rinse water within the supply pipe enters the inlet bore of the injector and partially mixes with the rinse aid fluid in the axial bore. This mixture is ejected into the final rinse water in the supply pipe through the at least one outlet bore of the injector.

The body of the injector should extend more than half way across the internal diameter of the supply pipe. Preferably, the body of the injector extends to a point adjacent that part of the supply pipe interior surface diametrically opposite the aperture in the supply pipe through which the injector extends.

In one embodiment of the present invention, the axial bore of the injector terminates near the center of the supply pipe. This end of the bore is intersected by a transverse bore through the injector body and forming a pair of diametrically opposed outlet ports directed transversely of the flow of the final rinse water through the supply pipe. The body of the injector extends substantially across the entire internal diameter of the supply pipe.

A second embodiment of the invention differs from the first only in that the axial bore of the injector body extends all the way through the injector body forming an opening at the free end thereof and adjacent the point on the interior wall of the supply pipe diametrically opposite the aperture in the supply pipe through which the injector body extends.

That end of the injector body located outside the supply pipe is connected to a source of rinse aid fluid under pressure. For example, it may be connected to a line leading from the output of a pump, the input of the pump, in turn, being connected to a rinse aid fluid reservoir.

DESCRIPTION OF THE PREFERRED EMBODIMENTS

Figure 1:
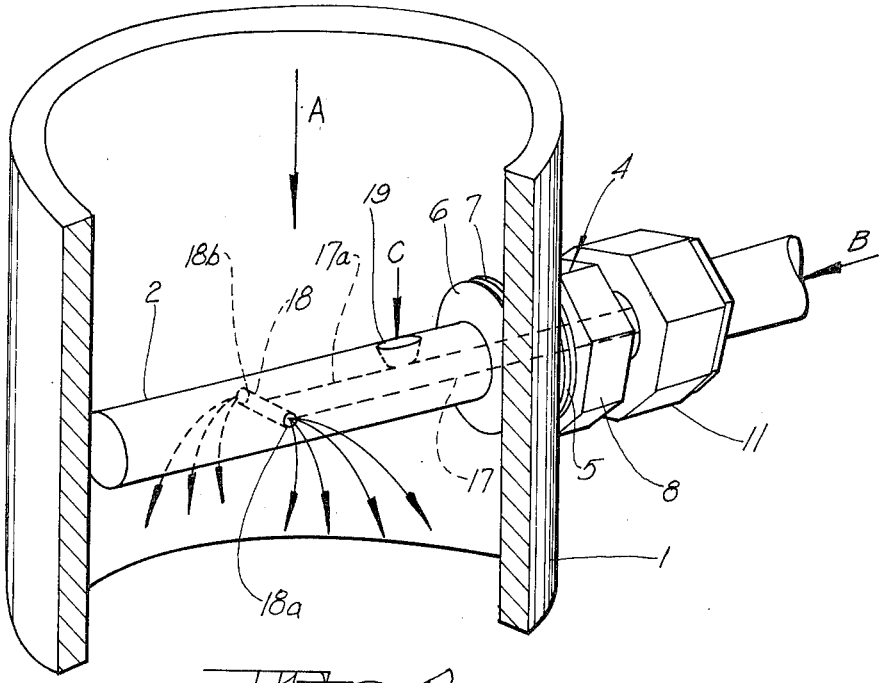
FIG. 1 is a fragmentary perspective view of a supply pipe provided with an injector of the present invention.
Figure 2:
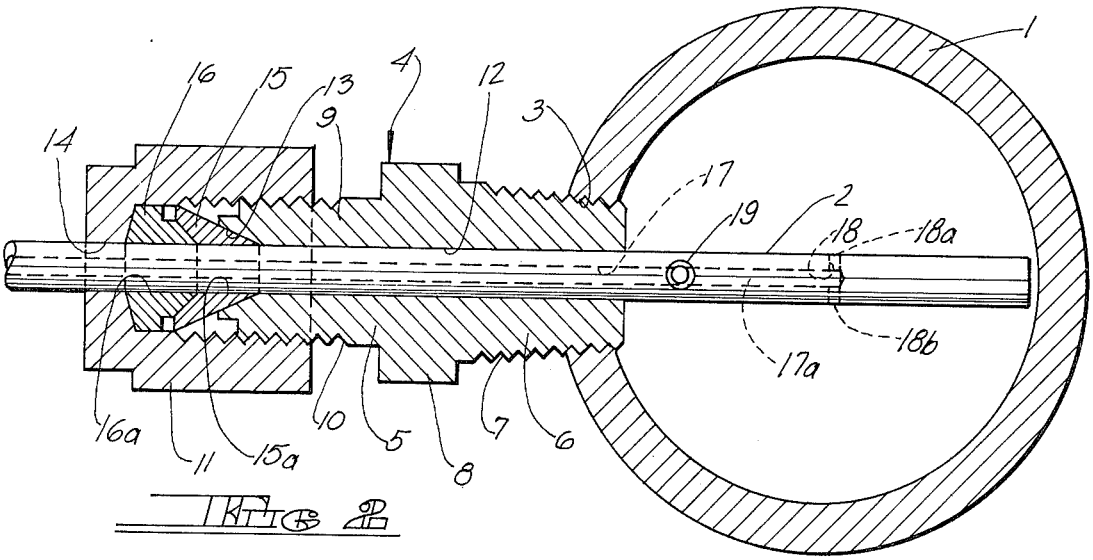
FIG. 2 is a plan view, partly in cross section, of the structure of FIG. 1.

Reference is first made to FIGS. 1 and 2, illustrating a first embodiment of the present invention, and wherein like parts have been given like index numerals. In keeping with the non-limiting exemplary application of the injector of the present invention being described, a final rinse water supply pipe of a commercial dishwasher is fragmentarily shown at 1. The elongated, rod-like injector is shown at 2. The injector 2 is mounted so as to extend transversely into the supply pipe 1 and transversely of the flow of the final rinse water in supply pipe 1, as illustrated. The flow of the final rinse water is indicated in FIG. 1 by arrow A.

The mounting of the injector 2 may be accomplished in any appropriate manner. For purposes of an exemplary showing, the supply pipe 1 is illustrated as having a female pipe port 3. The injector 2 is shown mounted through the port 3 by means of a conventional male tubing connector, generally indicated at 4. Briefly, the male tubing connector comprises a body 5 having a nose portion 6 provided with a pipe thread 7 and engageable in the female pipe port 3 with a fluid-tight fit. The body 5 has a central portion 8 engageable by a wrench or the like. Finally, the body 5 has a rearward cylindrical portion 9 which is externally threaded as at 10. The threads 10 are engageable by an internally threaded nut 11.

The body portion 5 has a central, axial bore 12, so sized as to just nicely receive the rod-like injector 2. The rearward end of the axial bore 12 flares or tapers outwardly to form a conical surface 13. The nut 11 is provided with a hole 14, sized to just nicely accommodate the injector 2 and coaxial with the bore 12.

To complete the structure of the male tubing connector 4, one or more clamping ferrules are provided. In the exemplary embodiment illustrated, a forward clamping ferrule is shown at 15 and a rearward clamping ferrule is illustrated at 16. The injector 2 passes through coaxial perforations 15*a* and 16*a* in ferrules 15 and 16, respectively. As is known in the art, ferrules 15 and 16 are adapted to cooperate with each other and with the interior surface of nut 11 and the conical surface 13 of body 4 in such a way that when the nut 11 is tightened on the body 4 the ferrules 15 and 16 will be slightly distorted to achieve a clamping engagement of the injector 2.

Attention is now directed to the injector 2, itself. The injector is provided with a axial bore 17 which extends from one end of the injector to a point at about the axial center of the supply pipe 1. The end of the axial bore 17 of the injector 2 is intersected by a transverse bore 18 of lesser cross sectional area (preferably about one-half the cross sectional area of axial bore 17), resulting in the formation of diametrically opposed outlet ports 18*a* and 18*b*. It will be evident from FIGS. 1 and 2 that the outlet ports 18*a* and 18*b* are directed transversely of the flow of the final rinse water through the supply pipe 1.

That portion of the injector 2 located within supply pipe 1 is also provided with an inlet bore 19. The inlet bore 19 may be of the same diameter as the axial bore 17 and may, if desired, taper upwardly and outwardly as shown in FIGS. 1 and 2. It will be noted from these figures that one end of inlet bore 19 faces the flow of the final rinse water in supply pipe 1. The other end of bore 19 communicates with the axial bore 17. It will further be noted that the inlet bore 19 is located in the injector upstream of outlet ports 18*a* and 18*b*. That end of the injector 2 which extends beyond nut 11 of the male tubing connector 4 will be connected to a source of rinse aid fluid under pressure, as will be described hereinafter.

The operation of the rinse aid injector of the present invention may be described as follows. Rinse aid fluid is pumped through axial bore 17, as is indicated by arrow B in FIG. 1. At the same time, final rinse water is flowing through supply pipe 1, as indicated by arrow A. Since that portion of the injector 2 located within supply pipe 1 extends transversely of the supply pipe and the flow of the final rinse water, the final rinse water must pass thereabout. As a result, the velocity of the final rinse water will increase at the sides of the injector (i.e. at the positions of ports 18*a* and 18*b* and therefor the pressure of the final rinse water at the ports will be lower than the nominal line pressure within supply pipe 1. This, in turn, will permit a small portion of the final rinse water to enter inlet bore 19, as indicated by arrow C. The incoming final rinse water will mix with the rinse aid fluid in that portion 17*a* of axial bore 17 between inlet bore 19 and outlet ports 18*a* and 18*b*. Since the transverse bore 18 preferably has a cross sectional area substantially half the cross sectional area of the axial bore 17 of the injector, the two outlet ports 18*a* and 18*b*, taken together, are approximately equivalent to the axial bore 17. The outlet ports 18*a* and 18*b* provide a path for ejection of the rinse aid fluid-final rinse water mixture which is transverse the flow of the final rinse water in supply pipe 1 so that the rinse aid fluid mixture will exit ports 18*a* and 18*b* in the manner shown by the plurality of arrows extending from these ports in FIG. 1.

The final rinse water passing through supply pipe 1 and having been split by the presence of the injector 2 will come together immediately beneath the injector 2 resulting in an area of turbulence just under the injector. This area of turbulence assures thorough dispersion and mixing of the rinse aid solution (from ports 18*a* and 18*b*) with the final rinse water passing through supply pipe 1 in the immediate area of the injector, so that the length of supply pipe 1 or the presence therein of right angle turns is no longer of importance.

Figure 3:
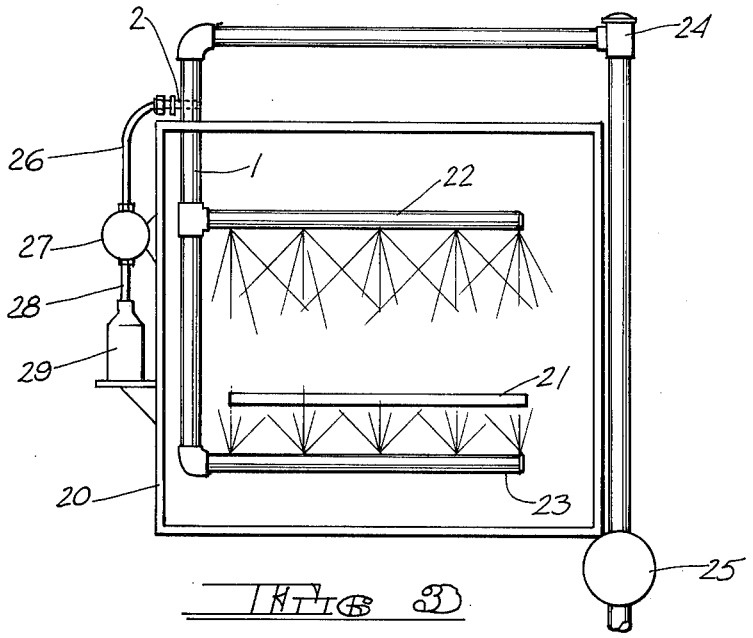
FIG. 3 is a semi-diagramatic end elevational view of a commercial dishwasher provided with the rinse aid injector of the present invention.

FIG. 3 illustrates in semi-diagramatic form the installation of the rinse aid injector of the present invention in the rinse water supply pipe of a commercial dishwasher. The dishwasher is shown at 20, having therewithin a conveyor 21 for tableware (not shown). For purposes of an exemplary showing, the dishwasher is illustrated as being provided with an upper rinse arch or nozzle 22 and a lower rinse arch or nozzle 23 by means of which the final rinse step is performed, the final rinse water being sprayed upon the tableware from both above and below. The final rinse water is supplied to the nozzles 22 and 23 by means of the final rinse water supply pipe 1. The supply pipe 1 may be provided with a siphon breaker 24 and a solenoid operated water valve 25, all as is well known in the art.

The rinse aid injector 2 of the present invention is shown mounted in the supply pipe 1. The injector 2 is connected by conduit 26 to the output of a pump 27. The input of pump 27, in turn, is connected by conduit 28 to a source of rinse aid fluid 29. The rinse aid fluid source 29 may be a reservoir for rinse aid fluid, or it may simply be the container in which the rinse aid fluid is packaged and shipped. Appropriate controls (not shown) may be provided to operate the pump 27. For example, the pump may be actuated by a pressure switch, responsive to pressure in the line 26 created by the opening of water valve 25 and the resulting flow of final rinse water through supply pipe 1.

Figure 4:
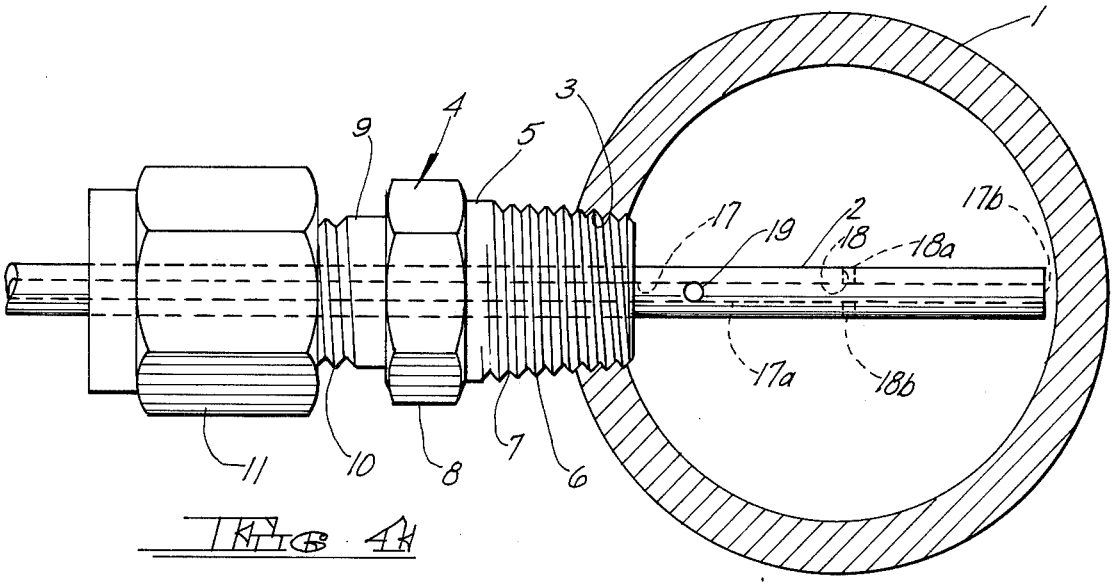
FIG. 4 is a plan view, partly in cross section, similar to FIG. 2 and illustrating a second embodiment of the rinse aid injector of the present invention.

A second embodiment of the rinse aid injector of the present invention is illustrated in FIG. 4. The injector is similar to that illustrated in FIGS. 1 and 2 and like parts have been given like index numerals. The embodiment of FIG. 4 differs from that of FIGS. 1 and 2 only in that the axial bore 17 of the injector 2 extends throughout the length of the injector, forming an opening 17*b* at the free end of the injector. While some of the mixture of rinse aid fluid and final rinse water from the portion 17*a* of axial bore 17 may exit the injector via the opening 17*b*, most of this mixture still exits via ports 18*a* and 18*b*. When the axial bore 17 does extend throughout the length of the injector 2, as shown in FIG. 4, it has been found that a more constant back pressure may be maintained on pump 27. While the reason for this is not fully understood and while not intending to be bound by theory, it is believed that some of the final rinse water in supply pipe 1 also enters the injector via the end opening 17*b*, thus resulting in the more consistent back pressure on pump 27 and in more thorough mixing of the rinse aid fluid and final rinse water within the injector 2.

In FIG. 4 the inlet bore 19 is shown as being non-tapered, as compared to the inlet bore 19 of FIG. 2. A tapered or non-tapered inlet bore may be used with either embodiment of the invention.

In both embodiments of the invention, it is desirable that that portion of the injector 2 located within supply pipe 1 extend at least more than half way across the supply pipe so that outlet ports 18*a* and 18*b* may be located at or near the axial center of supply pipe 1.

In both embodiments it is preferred that the injector 2 extend all the way across the supply pipe 1 until its free end contacts the inside surface of the supply pipe or is slightly spaced therefrom as shown in FIGS. 2 and 4. By extending the injector 2 across the supply pipe 1 a better area of turbulence is achieved immediately beneath the injector providing better dispersion and mixing of the rinse aid fluid in the final rinse water.

EXAMPLE

Both embodiments of the present invention have been tested. To this end each embodiment was mounted in a final rinse water supply pipe having an internal diameter of three-fourths inch. Each of the injector embodiments was mounted in the supply pipe through the use of a conventional male tubing connector sold under the mark "SWAGELOK" by The Crawford Fitting Company, Solon, Ohio. In each embodiment the axial bore 17 of the injector had a diameter of three-thirty seconds inch, as did inlet bore 19. Transverse bore 18 forming outlet ports 18*a* and 18*b* had a diameter of one-sixteenth inch. The flow of final rinse water through the supply pipe was at a nominal pressure of 20 psig. The flow of rinse aid to the injector was at a pressure typically slightly greater than 20 psig. Each of the injector embodiments was tested with various rinse aid fluids having viscosities ranging from 1 cps to 900 cps. Excellent mixing in the vicinity of the injector was achieved in each instance.

Modifications may be made in the invention without departing from the spirit of it.

The embodiments of the invention in which an exclusive property or privilege is claimed are defined as follows:

1. A fluid injector for the introduction, dispersion and mixing of a first fluid into a second fluid flowing through a conduit, said fluid injector comprising an elongated body mounted in fluid tight fashion through an aperture in the side of said conduit with a first portion and first end of said body located within said conduit and a second portion and second end of said body located exteriorly of said conduit, said first portion of said body extending transversely of the interior of said conduit and transversely of said flow of said second fluid therein, said injector body having a bore extending axially thereof from said second body end and connectable at said second body end to a source of said first fluid under pressure said axial bore communicating with at least one outlet bore extending transversely of said injector body and located within said conduit near the center thereof, said injector body having a transverse inlet bore within said conduit, one end of said inlet bore facing said flow of said second fluid within said conduit and the other end of said inlet bore communicating with said axial bore of said injector body ahead of said at least one outlet bore, whereby a portion of said second fluid enters said inlet bore of said injector and is conducted to said axial bore of said injector to mix therein with said first fluid, the mixture being ejected into the flow of second fluid within the conduit through the at least one injector outlet bore.

2. The structure claimed in claim 1 including a pair of outlet bores extending transversely of said injector body and located to either side of said axial bore, the axes of said outlet bores being perpendicular to the axis of said conduit.

3. The structure claimed in claim 1 wherein said axial bore extends the length of said injector body forming an opening in said first end of said injector body.

4. The structure claimed in claim 1 wherein said first portion of said injector extends across the interior of said conduit with the first end of said injector body being located adjacent the interior wall of said conduit diametrically opposite said aperture.

5. The structure claimed in claim 1 wherein said elongated injector body is rod-like and of circular cross section.

6. The structure claimed in claim 1 wherein the axis of said at least one outlet bore is perpendicular to the axis of said conduit.

7. The structure claimed in claim 1 wherein said first fluid comprises a rinse aid fluid, said second fluid comprising the final rinse water of a commercial dishwasher, said conduit comprising the final rinse water supply pipe for said commercial dishwasher.

8. The structure claimed in claim 2 wherein the axes of said outlet bores are coaxial.

9. The structure claimed in claim 2 wherein said inlet bore and said axial bore are of the same diameter and said outlet bores are each of a cross sectional area approximately one-half the cross sectional area of said axial bore.

10. The structure claimed in claim 9 wherein said first portion of said injector extends across the interior of said conduit with the first end of said injector body being located adjacent the interior wall of said conduit diametrically opposite said aperture.

11. The structure claimed in claim 10 wherein said axial bore extends the length of said injector body forming an opening in said first end of said injector body.

12. The structure claimed in claim 11 wherein said elongated injector body is rod-like and of circular cross section.

* * * * *